United States Patent [19]

Komatsu et al.

[11] 3,971,093

[45] July 27, 1976

[54] MOP HAVING A WASHING RESISTANCE

[75] Inventors: Toshiyoshi Komatsu, Osaka; Keizo Chimura, Toyonaka, both of Japan

[73] Assignee: Duskin Franchise Co., Ltd., Osaka, Japan

[22] Filed: Oct. 25, 1973

[21] Appl. No.: 409,455

Related U.S. Application Data

[63] Continuation-in-part of Ser. No. 180,141, Sept. 13, 1971, abandoned.

[52] U.S. Cl. ..... 15/104.93; 8/115.6; 15/229 R; 57/139; 57/140 BY; 57/153; 252/88

[51] Int. Cl.[2] ..... A47L 13/17; A47L 13/20; D02G 3/36

[58] Field of Search..... 15/229 R, 229 A, 229 AP, 15/229 BP, 104.93, 104.94; 57/139, 140 BY, 153

[56] References Cited

UNITED STATES PATENTS

| | | | |
|---|---|---|---|
| 2,409,660 | 10/1946 | Briggs | 15/229 R |
| 2,825,914 | 3/1958 | Moss | 15/229 R |
| 3,805,315 | 4/1974 | Moss | 15/229 A |

*Primary Examiner*—Daniel Blum
*Attorney, Agent, or Firm*—Cushman, Darby & Cushman

[57] ABSTRACT

A mop for dusting use having and an excellent washing resistance employing a special thick cotton folded yarn as mop-head piles, the folded yarn but having a loose twist just within a specific range of twist number calculated from the formulas exhibited in the instant specification and are mercerized under the specific conditions to be contracted over 10 to 30% of the original yarn length. The dimensional and configurational stabilization and fixation of the twisted form of folded yarn are the intended aim of the mercerizing treatment, which realize the retainment of the twisted form, pliability and free mobility of individual pile in mop-head, even though the mop is subjected to severe washing treatment repeatedly.

2 Claims, No Drawings

MOP HAVING A WASHING RESISTANCE

This application is a continuation-in-part application of our copending application Ser. No. 180,141 filed on Sept. 13, 1971, which is now abandoned.

BACKGROUND OF THE INVENTION

1. Field of the Invention

This invention relates to a mop to be used for dusting floor surfaces and other solid surfaces. More particularly, the invention relates to a mop having a prominently improved cleaning effect and an excellent washing resistance in combination.

2. The description of the Prior Art

In principle, mops are composed of tuft-like piles and a substrate cloth to which the piles are fixed.

In general, such mops are prepared by cutting thick folded yarns in appropriate uniform lengths and sewing the central portions of the yarns to the substrate cloth by tufting thick folded yarns on the substrate cloth simultaneously cutting them in appropriate uniform lengths. Accordingly, in many cases, the cut ends of the piles are left untreated after cutting.

The function of the mop depends essentially on properties and activities of piles cut into tufts having a uniform length. The most fatal defect of the conventional mops resides in that resistance of such piles aainst the external force imposed at the washing treatment is extremely low and they are untwisted instantaneously at the washing treatment, with the result of that the piles are frayed out into individual yarns or constituent fiber groups, and they are entangled with each other yielding a large quantity of yarn wastes. Accordingly, the conventional mops are greatly worn away by the washing treatment and as detailed hereinafter, the function as the dusting mop is drastically degraded. This invention intends to overcome this defect involved in the conventional mops and provides a mop excellent in both the washing resistance and the dusting effect by fixing twisted form of the yarn.

The term "yarn" used in the instant specification and claims is meant a thick fiber bundle formed by folding a number of thick single yarns. For instance, several thick single yarns of count No. 1, 2 or 3 are folded to form such yarn. The apparent diameter of the yarn is as great as about 2 to about 10 mm, and thus, the yarn used in this invention is special one of a greater size that is not seen among ordinary weaving yarns and sewing yarns. Such yarn is a product formed especially for use in preparing mops. In this invention, the term "pile" is used to indicate such yarn fixed in the mop-head, and the term "yarn" is used only to indicate the raw material yarn ready for use of making mops.

As the fibrous material of the yarn there are generally employed cotton fibers or mixed cotton fibers with a small amount of cellulosic chemical fibers such as rayon or acetate fibers and/or synthetic fibers such as polyester, vinylon, nylon and acrylic fibers, etc. It has long been known that such yarns of cotton fibers and yarns composed mainly of cotton fibers lack by nature in the twist-setting property, and when they are subjected to the washing treatment, their twists are quickly released expandingly from their cut ends and are frayed in disorder yielding a large quantity of yarn wastes, resulting in a great loss.

Such fraying of pile results in not only a quantitative loss brought about by yarn wastes frayed apart from the pile but also a qualitative loss of deteriorating mop function. More specifically, the untwisted piles fall into entangling and come to take an appearance resembling a fiber mass. Advantages of mops over plain fabrics are owing to a large surface area brought about by individual and independent piles and to three-dimensional movements of these piles. Accordingly, if their form is changed into one resembling a fiber mass, the surface area is drastically decreased and the advantages brought about by the three-dimensional movements of piles is entirely lost. And thus, the dusting efficiency of such mop is low down to a level attainable by woven fabrics.

At present, a large quantities of mops are made for dusting utilization. Aabove all, with the recent development of the dry maintenance techniques, utilization of mops impregnated with a special oil composition for absorbing dusts thereon prevails rapidly. Further, since such oil-treated mops become available under the rental system, they have been used in ordinary households and demands for them have been rapidly increasing.

In general, these rental mops are recovered after they have been rented to users for a certain prescribed period, and washed for re-use; this cycle is repeated. The regeneration of such used mops being extremely soiled with adsorbed dirt is necessitate to perform a very effective washing under severe conditions as not conceivable from the general concept of laundry, that is, using a large amounts of detergents and washed by means of a so-called beating method in a large rotary washing machine for industrial uses. Furthermore, the intended cleanness is frequently unattainable unless such washing procedure is repeated. The increase of frequency of regeneration of used mops by such washing procedure will reduce the cost of rental products, resulting in reduction of the economical burden on users. However, this frequency of regeneration of used mops should naturally be controlled by the washing resistance of the mops, i.e., the washing resistance of piles.

It has been well known that the improvement of the washing resistance of piles will be attained by preventing untwisting of piles from their cut-ends, and various methods have been proposed and practised to prevent fraying of piles. However, no satisfactory method has yet been developed. For instance, various resin-processing methods have been tried to fix the twisted form of piles by fiber-to-fiber bonding, but according to such methods, the pliability and mobility of piles are rather degraded and the fraying-preventive effect is not so conspicuously improved, whatever kinds of resins are employed for processing. Further, the tensile strength of the pile is rather lowered by the resin processing. Thus, the mop-pile which have the faculty of keeping their twisted form stably against washing action have long been searched for in the mop industry.

As a result of close examinations of fraying of mop piles caused by the washing action in water, we found that the formation of yarn wastes is not caused by breakages of cotton fibers but by slippages among fibers. More specifically, it was found that the constituent fibers of the piles are pulled apart or separated from the piles during the washing treatment, resulting in formation of yarn wastes. It was also found that such phenomenon is caused to occur regardless of short or long staples of the constituent fibers.

Based on such analysis of the fraying phenomenon of mop piles, we have made various investigations, and have now found that the yarn composed of cotton or mainly of cotton fibers can be set up to retain an excellent washing resistance when they have a soft twist just within a specific range of twist number and are mercerized under specific conditions detailed hereinafter; and by employing such specifically treated yarns, there can be obtained a novel mop having a highly improved washing resistance and an excellent dusting efficiency in combination.

SUMMARY OF THE INVENTION

It is therefore a primary object of this invention to provide a mop in which fraying of piles from cut ends thereof can be effectively prevented even when the mop is washed under severe conditions and in which the piles can retain substantially their original twisted forms even when the mop is subjected to the industrial washing operation repeatedly for many times and hence, individual pile can posses a large surface area independently even after such repetition of the industrial washing operation.

Another object of this invention is to provide a novel mop in which the original twisted form of mop piles is effectively retained without degradation of the pliability and free mobility of them, even the severe washing treatment of mop is repeated frequently.

Still another object of this invention is to provide a mop which is excellent in the property of absorbing and retaining an oil composition for catching dust particles and which adsorbs dust particles effectively thereon from the wiped surfaces without leaving on that surface an oily film, as well as without releasing the adsorbed particles to the next surface wiped thereby.

Other objects and advantages of this invention will be apparent from the description given hereinafter.

DETAILED DESCRIPTION OF THE INVENTION

In accordance with this invention, there is provided a mop having an excellent washing resistance, which comprises a fibrous substrate and piles fixed on said fibrous substrate, each of said piles having an apparent diameter ranging from 2 to 10mm. and a length of 3 to 30 cm. as measured from the cut end point to the point fixed on said substrate, wherein each of said piles is obtained by subjecting a loosely twisted fold yarn of a plurality of thick single yarns of cotton fibers or mixture of at least 70% by weight of cotton fibers with up to 30% by weight of artificial fibers, to the mercerizing treatment substantially without tension under such conditions that the yarn is contracted over 10 to 30% in length, said starting yarn having a single yarn twist coefficient of 3 to 4 as calculated from following formula $$K = \frac{t_1}{\sqrt{S}}$$

wherein K designates the twist coefficient of the signle yarn, $t_1$ stands for the twist number (twists/inch) of the single yarn and S designates the number of the count of the single yarn, and having a folded yarn twist coefficient of 1 to 2 as calculated from the following formula $$f = \frac{t_2}{t_1} \times \sqrt{N}$$

wherein $f$ designates the twist coefficient of the folded yarn, $t_1$ stands for the twist number (twists/inch) of the single yarn, $t_2$ designates the twist number (twists/inch) of the folded yarn and N stands for the number of single yarns constituting the folded yarn, and wherein each of said folded yarns is substantially prevented completely from fraying from their cut end at the time of washing being owed to said mercerizing treatment.

The mop of this invention comprises a fibrous substrate and tuft-like piles fixed on said fibrous substrate.

Any of known fibrous materials capable of fixing pile yarns thereon by sewing or by tufting can be used as the fibrous substrate in this invention. For instance, a woven fabric such as a canvas, a net cloth, a knitted cloth, a non-woven fabric and the like.

It is also possible to prepare a so-called substrate-free mop by employing a ribbon-like material as the fibrous substrate. In the case of a conventional substrate-free mop, the tendency of piles to fray by the washing treatment is so great and the entanglement of the pile and the yarn loss are enhanced. In contrast, in the case of a substrate-free mop made with use of mercerized yarn of this invention, such defect can be overcome effectively.

According to this invention, folded yarns having specific properties detailed hereinafter are fixed in the tuft-like form on the above-mentioned fibrous substrate, and thus is obtained a fine mop.

It is very important for dusting mop that each of the piles has a plenty of pliability and free mobility and a large surface area. For attaining this feature, it is indispensable that each of the piles should have a relatively large apparent diameter ranging from 2 to 10 mm., preferably 5 to 10mm.

It is generally preferred that the length of the piles as measured from the cut end point to the point fixed on the substrate is within a range of 3 to 30cm., 10 to 15cm. in general.

The folded yarn to be used in this invention can be obtained by subjecting a loosely twisted yarn of a specific twist coefficient formed by folding a plurality of single yarns composed of cotton fibers alone or mixture of at least 70% by weight of cotton fibers with up to 30% by weight of other artificial fibers, to the mercerizing treatment under specific conditions.

Cotton fibers produced at various locales can be used in this invention, however, it is desirable that cotton fibers have a fiber length of at least average value of 0.8 inch. As the artificial fibers, there can be employed, for instance, cellulosic artificial fibers such as rayon and acetate fibers, polyester fibers such as polyethyleneterephthalate and poly-para-oxyethylene-benzoate fibers, fibers of polyvinyl alcohols or partially acetalized products thereof, fibers of nylons such as polycaprolactam, and polyhexamethylene adipamide, acrylic fibers and fibers of polyolefins such as polypropylene.

These artificial fibers are incorporated into cotton fibers in the form of so-called staple fibers in the amounts not exceeding 30% by weight. In the case of that the artificial fibers are exceeded over the amounts of 30% by weight, the ability of the mop piles to absorb and retain an oil composition is degraded, and more-over, the effect of mercerizing treatment detailed hereinafter will be lost.

Single yarns of cotton fibers or a mixture of cotton fibers with artificial fibers can be obtained by spinning cotton fibers or a combination of cotton fibers and artificial fibers according to a customary spinning method.

In this invention, it is preferred that spun yarns are used as the single yarn, but it is possible to employ interlaced yarns formed by employing jets of fluids, which have recently been used in the art instead of spun yarns.

The single yarn to be used in this invention is one called thick yarn in the art. In general, single yarns of a count number of 1 to 10, preferably 1 to 5, are employed.

These single yarns are folded to form a loosely twisted fold yarn which will have an apparent diameter of 2 to 10 mm. after the mercerizing treatment. The number of the single yarns to be folded is not particularly critical in this invention. In general, 2 to 10 single yarns are folded. The count number of the single yarn and the number of the single yarns to be folded are so selected that the mercerized yarn will have an apparent diameter within the above range.

The yarn namely the folded yarn, to be subjected to the mercerizing treatment has a single yarn twist coefficient of 3 to 4 as calculated from the following formula $$K = \frac{t_1}{\sqrt{S}}$$

wherein K designates the twist coefficient of the single yarn, $t_1$ stands for a twist number (twists/inch) of the single yarn and S designates the number of the count of the single yarn, and has a folded yarn twist coefficient of 1 to 2 as calculated from the following formula $$f = \frac{t_2}{t_1} \times \sqrt{N}$$

wherein $f$ designated the twist coefficient of the folded yarn, $t_1$ stands for the twist number (twists/inch) of the single yarn, $t_2$ designates the twist number (twists/inch) of the folded yarn and N stands for the number of single yarns constituting the folded yarn.

In order to prevent the mop pile from fraying from their own cut end thereof, it is essential that the above two requirements should be satisfied.

When a mop is prepared from the folded obtained by using single spun yarns already being mercerized, the improvement of the washing resistance intended in this invention cannot be attained. Further, in case of each of the twist coefficients K and $f$ is lower than the range specified in this invention, the tendency of the piles to fray from the cut end is extremely great. Spun yarns or sewing yarns usually employed for weaving or knitting have values of K and $f$ are much greater than the values included within the ranges specified in this invention.

Spun yarns composed of cotton fibers or spun yarns composed mainly of cotton fibers lack by nature in the twist-setting property, and under the washing treatment or the like, the twists are instantaneously released from cut ends of the yarns and their fraying tendency is extremely great. This tendency is especially conspicuous in the case of spun single yarns or lowly twisted fold yarns, i.e., so-called loosely twisted yarns. Accordingly, in cotton yarns for weaving or sewing, a high twist is generally imparted to the yarn. In contrast, in this invention, a yarn twisted more loosely than ordinary weaving or sewing yarns, namely a yarn having values of K and $f$ within the above-mentioned ranges, is employed, and when this loosely twisted yarn is subjected to the specific mercerizing treatment detailed hereinafter, fraying of the yarn from the cut end can be prevented substantially in the resulting pile. This fact is quite surprising and unexpected from the above-mentioned common sense held in the art.

In this invention, the yarn composed of the above-mentioned loosely twisted fold yarn is subjected to the mercerizing treatment substantially without tension under such conditions that the yarn is contracted over 10 to 30% in length. This requirement is especially important for improving the washing resistance and dusting effect of the resulting mop piles.

The mercerizing treatment has heretofore been known as the finishing treatment of cotton for giving them luster resembling those of silk and/or improving the property of absorbing dyes or chemicals. However, as far as we known, the mercerizing treatment has not ever been applied to the manufacture of mop piles, and furthermore, it is unknown at all that when the loosely twisted yarn having twist coefficients K and $f$ within the above-mentioned specific ranges is subjected to the mercerizing treatment and such mercerized yarns are employed for the manufacture of mops, there can be obtained mops having a highly improved washing resistance in which fraying of the piles from the cut ends thereof can be substantially prevented completely at the washing treatment.

We found that fraying of yarns caused by washing piles of a mop is closely concerned with the contraction of the starting yarn at the mercerizing treatment. We furthered our research works based on this finding, we have now found that in the case of the contraction of the starting yarn could not exceed 10% at the mercerizing treatment, the degree of fraying of the treated yarn at the washing treatment is drastically lowered, and thus, we have now arrived at this invention.

In case the contraction of the starting yarn at the mercerizing treatment does not exceed 10%, a significant improvement of the washing resistance can not be attained. In contrast, when the contraction of the starting yarn exceeds 30%, the dimension loss of the yarn by contraction becomes great and there is brought about an undesired phenomenon that entanglements are caused among treated yarn. Accordingly, too great a contraction is not preferred for attaining the objects of this invention.

As shown in Examples given hereinafter, when the contraction of the yarn at the mercerizing treatment is plotted with respect to the washing resistance (the length of the yarn fraying at the washing treatment), it is seen that the degree of the improvement of the washing resistance is enhanced most conspicuously when the contraction of the starting yarn reaches within a range of 10 to 13% or 10 to 15%, though the degree of the improvement varies to some extent depending on the kinds of the starting yarn, namely the production locale of the starting cotton, the raw cotton composition of yarn-constituting cotton fibers, or the kind and mixing ratio of artificial fibers blended in cotton fibers, and that even when the contraction of the yarn exceeds the above range, the increase of the washing resistance is not so conspicuous.

Accordingly, in this invention it is desired that the mercerizing treatment is conducted under such conditions that the starting yarn is contracted by 13 to 30%, preferably 15 to 30%.

In this invention the mercerizing treatment is carried out substantially without tension under such conditions as will be allowed the contraction of the starting yarn within the above-mentioned range. The term mercerizing treatment substantially without tension used in the instant specification and claims means the mercerizing treatment in which only a tension allowing the contraction of the starting yarn within the above range of from 10 to 30% is given to the starting yarn. Accordingly, the mercerizing treatment of this invention includes, for instance, a treatment where, when the intended contraction is 20%, the starting yarn is allowed to stand substantially without tension untill the contraction reaches 20% and once the contraction reaches 20%, a tension is imparted to the yarn so that no further contraction is brought about.

As far as the foregoing two requirements are satisfied, other mercerizing treatment conditions are not particularly critical in this invention. For instance, an alkaline aqueous solution usually adopted for the mercerizing treatment is also used in this invention as the mercerizing bath. Hydroxides, carbonates and bicarbonates of alkali metals are employed as the alkaline substance to be added to the mercerizing bath. In general, it is preferred that alkali metal hydroxides such as sodium hydroxide and potassium hydroxide are employed. Especially good results are obtained by the use of sodium hydroxide. It is generally preferred that the concentration of the alkaline substance in the treating bath is within a range of from 10 to 36%. At an alkaline substance concentration not exceeding 10%, it is generally difficult to allow the starting yarn to contract by 10% or more, with the result that it is difficult to obtain a pile for a mop having an excellent washing resistance. In contrast, at an alkaline substance concentration higher than 36%, though a satisfied improvement of the washing resistance can be attained in the resulting pile, the strength of the yarn is reduced and there are brought about such operation troubles as difficulties involved in the treatment of washing the mercerized yarn to remove off the alkaline substance. Accordingly, it is not preferable to employ a treating bath containing an alkaline substance at too high or low concentration.

In this invention it is generally desired that the mercerizing bath contains an alkaline substance such as sodium hydroxide at a concentration ranging from 15 to 30%, especially from 18 to 28%.

In addition to the alkaline substance, various assistants and additives can be added to the mercerizing bath. For instance, a known anionic or non-ionic surfactant such as a sodium salt of sulfonated fatty acid ester or the like can be added in an amount of 0.1 to 1.0% by weight as a penetrating agent for promoting the penetration and diffusion of the alkaline aqueous solution into the yarn.

The mercerizing temperature and time are not particularly critical in this invention, as far as the yarn is allowed at the mercerizing treatment to contract by 10 to 30%. For instance, it is generally preferred that the mercerizing treatment is conducted at a temperature ranging from 10° to 70°C., especially at room temperature. In case the mercerizing treatment is carried out at room temperature, no particular temperature control need be effected and the mercerizing operations can be greatly facilitated. It is sufficient to conduct the mercerizing treatment for a period of time enough for the alkaline solution to penetrate into the yarn and cause the dimensional and configurational changes of the constituent fibers as well as the yarn to reach the equilibrium state. This period is generally within a range from 5 to 30 minutes. Of course, the use of a penetrating agent such as mentioned above can shorten this period.

Various means can be adopted for performing the mercerizng treatment while maintaining the yarn substantially without tension. For instance, the mercerizing treatment can be performed either batchwise or continuously. In the case of the continuous method, the starting yarns are continuously fed into a mercerizing treatment bath, and the yarns immersed in the bath for the prescribed period of time are withdrawn from the treatment bath at a rate lower than the feed rate, namely at a rate reduced in correspondence to the contraction of the yarn. In the case of the batchwise method, a yarn reeled on a hank or the like is rotated at a low speed and an alkaline solution is sprinkled on such yarn.

In this case, it is preferred that means for gradually diminishing the hank reel with the advance of the treatment in order to allow the yarn to contract freely and prevent the treated yarn from taking an agglomerate or dough-like form.

Although the yarn is subjected to the mercerizing treatment prior to formation of a mop in the foregoing embodiments, it is also possible in this invention to adopt a method comprising cutting yarns into a prescribed uniform length, sewing them on the fibrous substrate to form a mop and then subjecting the yarns arranged to have a mop form to the mercerizing treatment.

The mercerized yarn is washed with water according to need, and it is washed with an acid to neutralize the remaining alkaline substance, followed by water washing, dehydration and drying. Thus is obtained a yarn for a mop.

According to this invention, as described hereinabove, a loosely twisted yarn composed mainly of cotton fibers and having twisting coefficients K and $f$ within the specific ranges is subjected to the abovementioned mercerizing treatment, whereby fraying of the piles of a mop from the cut end thereof can be effectively prevented at the washing treatment conducted under severe conditions for regeneration of the used mop and even when the pile is subjected repeatedly to such washing treatment conducted under severe conditions, it can retain a form quite resembling the original twisted form for a long period of time. The mechanism by which the washing resistance can be highly improved in the pile of this invention has not yet been elucidated completely. However, in view of the fact that even when single cotton yarns are mercerized and then folded, the fraying-preventive effect cannot be obtained, and the intended improvement of the washing resistance cannot be also attained in the case of a strongly twisted yarn, it may be construed that only when a yarn having twist coefficients K and $f$ within the abovementioned specific ranges are mercerized so that they contract by 10 to 30%, individual fibers are swollen with the alkaline substance and contracted in such a manner that the new dimensional and configurational stabilization of the twisted form as the entire group of the fibers are accomplished, whereby the fixation of the twisted form is attained most effectively sufficient to prevent slippage among the fibers at the washing treatment.

The mop of this invention has not only a prominently enhanced washing resistance of piles but also various advantages as regards the cleaning efficiency. More specifically, since in the mop of this invention individual pile yarns can be kept in the independent state, even when it is used over a long period of time, the individual and free mobility and large surface area can be retained in each of the piles and therefore, the mop of this invention exhibits an excellent property of adsorbing dusts. Further, the piles of the mop of this invention are excellent in properties of absorbing and retaining oil composition for dust-catching, and therefore, the dusting effect can be endured for a very long time, showing no tendency to leave on the wiped surface an oily film as well as to release the adsorbed dust-particles to the next surface dusted thereby.

The mop of this invention is also suitable for an ordinary water mop which is usually employed for cleaning floor surfaces after it has been wetted with water, but especially good results are obtained when it is used as an oil-treated mop. In this case of the oil-treated mop, an oil-composition of dust-catching property is impregnated in the mop in an amount of 10 to 36% by weight, preferably 18 to 26% by weight, based on the mop weight. Such oil-compositions usually comprises a non-drying mineral oil as the main ingredient and 0.5 to 20% by weight, generally 1 to 5% by weight, of a cationic surfactant or a combination of cationic and non-ionic surfactants, and optional components such as bacteriostatic and fungicidal agents to be incorporated according to need are known in the art as dust-catching oil compositions. These known oil-compositions can be used conveniently in this invention. Suitable instances of such oil-compositions are illustrated, for instance, in the specifications of U.S. Pat. Nos. 3,200,036 and 3,391,079.

This invention will now be illustrated more detailedly by reference to Examples, but the scope of this invention is not at all limited by these examples.

EXAMPLE 1

A penetrating agent (a sodium salt of sulfonated fatty acid ester, the product manufactured and sold under the tradename San Molin AM by Sanyo Chemical Industry Co., Ltd., Japan) was added in an amount of 0.1% to an aqueous solution containing sodium hydroxide at a concentration indicated, in Table 1 given hereinafter. Thus were obtained 5 kinds of mercerizing baths differing in the sodium hydroxide concentration.

With use of each of the so formed mercerizing baths, thick folded yarns composed of pure cotton were mercerized for 15 minutes substantially without tension at a temperature indicated in Table 1. Each of the mercerized yarn was washed with water, soured with 1% aqueous solution of acetic acid, then washed with water again, dehydrated and dried. These post treatments were conducted under the same conditions with respect to all of the mercerized folded yarns. Then, the final contraction brought about by the mercerizing treatment was determined with respect to each sample yarns. The obtained results are shown in Table 1.

Folded yarns used in the above test had the following characteristics:

count number (S) of single yarn: No. 1
single yarn twist number ($t_1$): 3 twists/inch
single yarn twist coefficient (K): 3
number (N) of single yarns folded: 2
folded yarn twist number ($t_2$): 3.5 twists/inch
folded yarn twist coefficient: 1.65

Each of the so obtained mercerized yarns was cut into 30 cm. length, and 5 of the so cut samples were gathered by binding them at centers thereof to form 5 pile yarns. Then, the yarns were subjected to the beating washing with use of a rotary washing machine to examine the state of fraying of yarns. Results are shown in Table 2.

Table 1

| Temperature (°C) | Contraction of folded yarns (%) NaOH Concentration (% by weight) 10 | 15 | 20 | 30 | 35 |
|---|---|---|---|---|---|
| 80 | 4.9 | 10.0 | 18.1 | 22.7 | 24.0 |
| 60 | 6.3 | 14.3 | 22.8 | 28.6 | 30.4 |
| 30 | 10.5 | 23.4 | 29.6 | 31.4 | 32.5 |
| 10 | 12.8 | 26.5 | 32.7 | 34.3 | 35.1 |

Table 2

| Temperature (°C) | State of Fraying of Yarns NaOH concentration (% by weight) 10 | 15 | 20 | 30 | 35 |
|---|---|---|---|---|---|
| 80 | X | X | O | O | O |
| 60 | X | X | O | O | Δ |
| 30 | X | O | O | O | Δ |
| 10 | X | O | O | Δ | Δ |

Notes

X: Fraying of yarns observed
O: Fraying of yarns not observed
Δ: Fraying of yarns not observed but entanglements of yarns observed
X: Fraying-preventive effect was seen to begin to manifest From the aforegoing results, it will readily be understood that when the mercerizing treatment is conducted so that the yarns are contracted by at least 10%, preferably at least 15%, fraying of the yarn from the cut end at the washing treatment can be prevented, and that the mercerizing treatment is conducted so that the contraction of the yarns exceeds 30%, a tendency of formation of yarn entanglements is brought about.

EXAMPLE 2

A pure cotton folded yarn (twist number of 3.5 twists/inch) formed by folding two cotton single yarns of a count number of 1 same as used in Example 1, which was reeled on a hank, was immersed for 10 minutes in a 20% aqueous solution of sodium hydroxide maintained at 25°C. under the conditions indicated below. The same penetrating agents as used in Example 1 (San Molin AM) was incorporated in an amount of 0.2% into the sodium hydroxide solution prior to the above treatment.

| Sample No. | Treatment Conditions |
|---|---|
| 1 | Immersed completely without tension. |
| 2 | Yarn was allowed to stand under no tension until it contracted by 20% of the original length and then, it was fixed to the hank so that no further contraction was brought about. |
| 3 | Yarn was allowed to stand under no tension until it contracted by 15% of the original length and then, |

-continued

| Sample No. | Treatment Conditions |
|---|---|
| | it was fixed to the hank so that no further contraction was brought about. |
| 4 | Yarn was allowed to stand under no tension until it contracted by 10% of the original length and then, it was fixed to the hank so that no further contraction was brought about. |
| 5 | Yarn was treated under such tension that it is retained the original length after the treatment. |
| 6 | Yarn was treated under such tension that the length of the treated yarn was 1.05 times the original length. |

Under the same conditions, each of these 6 treated samples was washed with water, soured with 1% aqueous solution of acetic acid, washed with water again, dehydrated and dried to obtain samples having a contraction ratio shown in Table 3. Each of these samples was cut into 30 cm. length and 5 of cut specimens were gathered by binding them at their centers to obtain 5 pile yarns. They were then subjected repeatedly to the beating washing with use of a rotary washing machine to examine the state of fraying of the folded yarn from the cut end. Results are shown in Table 3, in which data of an untreated yarn of same kind are also shown.

The value of fraying length was determined by measuring the length of the non-fraying portion in view of the fact that falling of fibers was sometimes caused to occur and correcting the measured length based on the realization of the original twist.

Table 3

| Sample No. | Contraction ratio after treatment (%) | Fraying length from cut end (cm) (Average value) Repetition frequency of washing 1 | 2 | 3 | 4 | 5 | 10 |
|---|---|---|---|---|---|---|---|
| 1 | 31.4 | 0.0 | 0.1 | 0.0 | 0.2 | 0.3 | 0.5 |
| 2 | 28.6 | 0.0 | 0.0 | 0.2 | 0.1 | 0.3 | 0.7 |
| 3 | 21.5 | 0.1 | 0.2 | 0.2 | 0.1 | 0.3 | 1.0 |
| 4 | 15.8 | 0.0 | 0.2 | 0.1 | 0.3 | 0.7 | 1.6 |
| 5 | 10.5 | 1.9 | 2.5 | 3.1 | 3.9 | 4.6 | 6.3 |
| 6 | 5.3 | 2.5 | 3.3 | 4.2 | 4.8 | 5.6 | 7.1 |
| untreated control | | 3.5 | 4.4 | 5.1 | 5.7 | 6.4 | 8.4 |

With respect to each sample, the weight loss was determined after every washing treatment to obtain results shown in Table 4.

Table 4

| Sample No. | Weight loss (%) by washing (average value of 5 pile yarns) Repetition frequency of washing 1 | 2 | 3 | 4 | 5 | 10 |
|---|---|---|---|---|---|---|
| 1 | 2.0 | 2.8 | 3.3 | 3.7 | 4.1 | 4.9 |
| 2 | 2.2 | 3.0 | 3.5 | 4.0 | 4.4 | 5.2 |
| 3 | 2.5 | 3.5 | 4.2 | 4.7 | 5.1 | 5.9 |
| 4 | 2.8 | 3.7 | 4.5 | 4.9 | 5.3 | 6.3 |

Table 4-continued

| Sample No. | Weight loss (%) by washing (average value of 5 pile yarns) Repetition frequency of washing 1 | 2 | 3 | 4 | 5 | 10 |
|---|---|---|---|---|---|---|
| 5 | 9.5 | 10.8 | 11.5 | 12.1 | 13.0 | 15.2 |
| 6 | 12.3 | 13.5 | 13.9 | 14.4 | 15.0 | 16.5 |
| Untreated Control | 15.2 | 16.8 | 17.3 | 17.9 | 18.6 | 20.5 |

From these results, it will readily be understood that when the mercerizing treatment is carried out so that the yarn is contracted by at least 10%, especially at least 15%, the water resistance is highly improved.

EXAMPLE 3

A loosely twisted cotton yarn (twist number of 3.5 twists/inch) formed by folding two pure cotton single yarns of a count number of 1 same as used in Example 1 was reeled on a hank having a periphery indicated in Table 5. In each case the winding number was 20. The reeled yarn was hung on a suspender arm, and a 20% aqueous solution of sodium hydroxide maintained at 30°C. was projected on the reeled yarn for about 10 minutes to penetrate the solution into the yarn. In the same manner as described in Example 2, the post treatments such as water washing, acid souring, re-washing with water, dehydration and drying were conducted to obtain samples. San Molin AM was added in an amount of 0.2% to the treating solution as a penetrating agent.

The samples were tested in the same manner as described in Example 2. The relation among the periphery of the hank, the contraction ratio and the fraying length after repetition of the washing treatment is shown in Table 5.

Table 5

| Sample No. | Hank periphery (cm) | Contraction ratio after treatment(%) | Fraying length (cm.)(Average value) Repetition frequency of washing 1 | 2 | 3 | 4 | 5 | 10 |
|---|---|---|---|---|---|---|---|---|
| 1 | 30 | 30.5 | 0.0 | 0.1 | 0.0 | 0.2 | 0.2 | 0.5 |
| 2 | 60 | 25.6 | 0.1 | 0.2 | 0.1 | 0.2 | 0.3 | 0.7 |
| 3 | 90 | 23.2 | 0.1 | 0.2 | 0.1 | 0.2 | 0.3 | 0.9 |
| 4 | 120 | 20.5 | 0.2 | 0.3 | 0.2 | 0.3 | 0.5 | 1.3 |
| 5 | 150 | 13.0 | 1.0 | 1.5 | 2.1 | 2.6 | 3.0 | 4.5 |
| 6 | 180 | 11.8 | 2.2 | 3.0 | 3.5 | 4.3 | 5.0 | 7.1 |
| 7 | 210 | 10.1 | 2.6 | 3.1 | 4.0 | 4.6 | 5.1 | 7.3 |
| Untreated control | — | — | 3.4 | 4.2 | 5.0 | 5.5 | 6.1 | 8.0 |

EXAMPLE 4

In this Example, the yarn was treated by employing a spray-type dyeing machine and it was confirmed that a tendency similar to that observed in the immersion test was obtained.

A 25% aqueous solution of sodium hydroxide in-corporated with 0.2% of San Molin AM as the penetrating agent and maintained at 50°C was circulated in a spray-system dyeing machine and it was sprayed and penetrated uniformly in a hank of a loosely twisted yarn (twist number of 3.5 twists/inch; same as used in Example 1) formed by folding two pure cotton single yarns of a count number of 1, which was hung on a spray arm and was being rotated very gradually. This treatment was conducted for 20 minutes. The solution was removed from the yarn, and the yarn in the state hung on the arm was washed with water, soured with an acid and washed with water again, following which the yarn was taken out of the arm, dehydrated by means of a centrifugal dehydrator and dried sufficiently in a hot air drier.

Since the periphery of the hank was changed as indicated in Table 6, the tension imposed on the wetted yarn by its own weight was correspondingly varied, which resulted in the difference of the contraction ratio in the treated yarns as indicated in Table 6. The so obtained samples were subjected to the repeated washing and the durability test according to the methods described in Examples 2 and 3 to obtain results shown in Table 6, from which it will readily be understood that even when the yarn is treated with an alkaline aqueous solution according to the spray method and some load is imposed on the yarn by its own weight or the weight of the solution sprayed and penetrated in the yarn, if the contraction is within the range specified in this invention, the fraying-preventive efffect can be obtained.

Table 6

| Sample No. | Periphery of hank (cm) | Contraction ratio after treatment (%) | Fraying length(cm)(Average value) Repetition frequency of washing 1 | 2 | 3 | 4 | 5 | 10 |
|---|---|---|---|---|---|---|---|---|
| 1 | 100 | 23 | 0.0 | 0.2 | 0.1 | 0.3 | 0.5 | 1.0 |
| 2 | 125 | 19 | 0.1 | 0.2 | 0.2 | 0.3 | 0.8 | 1.2 |
| 3 | 150 | 13 | 1.5 | 2.3 | 2.7 | 3.5 | 4.1 | 4.9 |
| 4 | 175 | 11 | 2.6 | 3.3 | 3.8 | 4.3 | 4.9 | 5.8 |
| 5 | 200 | 8 | 3.1 | 3.9 | 4.6 | 5.3 | 5.9 | 7.1 |

Table 8

| Sample No. | Periphery of hank (cm) | Contraction ratio after treatment(%) | Fraying length after washing(cm) (Average value) Repetition frequency of washing 1 | 2 | 3 | 4 | 5 | 10 |
|---|---|---|---|---|---|---|---|---|
| 1 | 30 | 28.5 | 0.0 | 0.1 | 0.0 | 0.2 | 0.2 | 0.4 |
| 2 | 60 | 24.5 | 0.1 | 0.2 | 0.1 | 0.2 | 0.3 | 0.6 |
| 3 | 90 | 22.6 | 0.2 | 0.3 | 0.2 | 0.4 | 0.5 | 0.8 |
| 4 | 120 | 19.1 | 0.3 | 0.1 | 0.3 | 0.4 | 0.6 | 1.0 |
| 5 | 150 | 12.5 | 1.1 | 1.6 | 2.5 | 3.1 | 3.5 | 4.3 |
| 6 | 180 | 10.3 | 1.9 | 2.8 | 3.3 | 4.1 | 4.8 | 6.8 |
| 7 | 210 | 9.2 | 2.4 | 3.0 | 3.8 | 4.4 | 4.9 | 7.1 |
| Untreated Control | — | — | 3.3 | 4.4 | 5.2 | 5.8 | 6.2 | 8.3 |

EXAMPLE 5

Instead of the pure cotton yarn, a folded yarn composed of a mixture of 70% by weight of cotton fibers and 30% by weight of acrylic fibers was employed, and the test was conducted in the same manner as in Example 2 under conditions (1) to (6) shown in Example 2 to obtain results indicated in Table 7. The yarn tested was formed by folding two single yarns of a cotton count number of 2 and was characterized by the $t_1$ value of 3 twists/inch, the $t_2$ value of 3.5 twists/inch, the K value of 3 and the $f$ value of 1.65.

Table 7

| Sample No. | Contraction ratio after treatment(%) | Length of yarn fraying from cut end(cm) (Average value) Repetition frequency of washing 1 | 2 | 3 | 4 | 5 | 10 |
|---|---|---|---|---|---|---|---|
| 1 | 30.3 | 0.0 | 0.1 | 0.1 | 0.0 | 0.2 | 0.3 |
| 2 | 27.5 | 0.1 | 0.0 | 0.1 | 0.2 | 0.3 | 0.5 |
| 3 | 21.0 | 0.2 | 0.1 | 0.1 | 0.3 | 0.4 | 0.8 |
| 4 | 16.3 | 0.3 | 0.2 | 0.4 | 0.5 | 0.8 | 1.6 |
| 5 | 11.2 | 2.0 | 2.4 | 2.9 | 3.5 | 4.1 | 5.6 |
| 6 | 7.5 | 2.3 | 3.1 | 3.9 | 4.7 | 5.2 | 6.6 |
| Untreated control | — | 4.6 | 4.6 | 5.3 | 5.9 | 6.8 | 8.1 |

From the above results, it will readily be understood that even in the case of a yarn composed of a mixture of 70% by weight of cotton fibers and 30% by weight of acrylic fibers, if the contraction ratio is 16.3% or higher, there can be obtained a mercerized yarn excellent in the washing resistance.

EXAMPLE 6

Instead of the pure cotton yarn, a yarn composed of a mixture of 80% by weight of cotton fibers and 20% by weight of polyester fibers was employed, and the test was conducted according to the method described in Example 3. The yarn tested corresponded to a loosely twisted yarn formed by folding 2 cotton single yarns of a count number of 2 and was characterized by the $t_1$ value of 3 twists/inch, the $t_2$ value of 3.5 twists/inch, the K value of 3 and the $f$ value of 1.65. The test results are shown in Table 8.

EXAMPLE 7

A 20% aqueous solution of sodium hydroxide containing 0.1 % of the penetrating agent was prepared and maintained at 30°C. The following three blend-spun yarns (each being loosely twisted yarn formed by folding two single yarns of a cotton count number of 1 and characterized by the $t_1$ value of 3 twists/inch, the $t_2$ value of 3.5 twists/inch, the K value of 3 and the $f$ value of 1.65) were immersed in the above solution for 10 minutes in the form of a hank (the length of one hank of the yarn being 500 cm.) while being maintained under no tension. The yarns were taken out of the solution, washed with water, soured with 1% aqueous solution of acetic acid, washed with water again, dehydrated and dried to obtain sample yarns. Each sample yarn was cut into 15 cm. length to obtain pile yarns. One end of the pile yarn was sewn on a vinylon canvas having a size of 5 cm. × 20 cm. 250 piles were sewn in this manner on the longer side of the canvas uniformly, and with respect to each blend-spun yarn, 300 sheets of such tufted canvas were prepared. The so prepared mops were subjected for 30 minutes to the beating washing by means of a rotary washing machine of the lateral type having a nominal capacity of 65 kg. This washing treatment was repeated 10 times. In each sample, the fraying of the yarn from the cut end was hardly observed. The starting three blend-spun yarns and the contraction ratio after the mercerizing treatment are shown in Table 9.

Table 9

| Sample No. | Blend-spun yarn | Contraction ratio after treatment (%) | Apparent yarn diameter after treatment (mm) |
|---|---|---|---|
| 1 | 70% of cotton and 30% of vinylon | 26.3 | about 6.0 |
| 2 | 70% of cotton, 15% of vinylon and 15% of polyester | 28.1 | " 6.5 |
| 3 | 85% of cotton and 15% of polyester | 29.8 | " 6.0 |

EXAMPLE 8

The following two folded yarn differing in the upper twist number were prepared by folding two pure cotton single yarns of a count number of 1, and they were immersed in the form of a hank in a 25% aqueous solution of sodium hydroxide containing 0.2% of the same penetrating agent as employed in Example 1 (San Molin AM), which was maintained at 25°C. In each yarn, the single yarn of a count number of 1 composed of pure cotton fibers was characterized by a twist number $t_1$ of 3 twists/inch and a twist coefficient K of 3. The folded yarn tested had the following twist number $t_2$ and twist coefficient $f$ is as shown in Table 10.

Table 10

| Sample No. | N value | $t_2$ (twists/inch) | f value |
|---|---|---|---|
| 1 | 2 | 3.5 | 1.65 |
| 2 | 2 | 4.9 | 2.30 |

Post treatment such as water washing were carried out in the same manner as in Example 1.

After the above mercerizing treatment, the sample 1 exhibited a good contraction state without formation of yarn entanglements, and it has a uniform quality and could be handled very easily.

In the case of the sample 2, extreme yarn entanglements were formed and it was difficult to reel it again in the form of an ordinary hank. Further, because of the presence of dough-like yarn agglomerates, post treatments such as acid washing and water washing could not be sufficiently conducted.

Each of these two mercerized yarns was cut into 30cm. length to obtain pile yarns. Then, 10 of such cut yarns were gathered by binding them at their centers. With respect to each sample, 10 of such assemblies of bound yarns were prepared and subjected repeatedly to the beating washing by means of a rotary washing machine to examine the fraying of the yarn from the cut end. In the case of the assemblies prepared from the sample 1 no fraying was observed, but in the case of the assemblies prepared from the sample 2, dough-like agglomerates were formed and about 3 yarns frayed in each assembly. This fact indicates that when the starting yarn has too great a twist number, lump-like twists are formed to give dough-like yarn agglomerates, which bring about troubles and disadvantages during post treatments and a uniform mercerizing treatment effect cannot be obtained.

Results of the above test are shown in Table 11.

Table 11

| Yarn | Sample 1 | Sample 2 |
|---|---|---|
| | $t_1 = 3$<br>K = 3<br>N = 2<br>$t_2 = 3.5$ (loosely twisted)<br>f = 1.65 | $t_1 = 3$<br>K = 3<br>N = 2<br>$t_2 = 4.9$(highly twisted)<br>f = 2.3 |
| Contraction ratio (%) | 30 | Unmeasurable because of presence of dough-like yarn agglomerates |
| Fraying after first washing | not observed | 30% |
| Weight loss after 10th washing | 4.8% | 8.3% |

EXAMPLE 9

The same folded yarn of two pure cotton single yarns of a count number of 1 as employed in Example 1 and single yarns of a count number of 1 separated from such folded yarn were respectively reeled on a hank immersed for about 10 minutes under no tension in a 20% aqueous solution of sodium hydroxide maintained at 30°C. Both the samples were water-washed, acid-washed, water-washed again, dehydrated and dried under the same conditions. In the case of the single yarn, after the above treatments, two of treated single yarns were folded. With respect to each of the foregoing two samples, the fraying test was conducted in the same manner as in Example 1.

In the case of the sample obtained by subjecting the folded yarn to mercerizing treatment, the washing could be conducted repeatedly without yarn fraying. In contrast, in the case of the sample obtained by mercerizing single yarns separately and then folding them, yarn fraying was caused to occur when the washing was conducted only once. Results of the test are shown in Table 12.

Table 12

| | Sample 1 | Sample 2 |
|---|---|---|
| Yarn | Formed by folding two mercerized single yarns ($t_2$ = 3.5 twists/inch) | Formed by mercerizing folded yarn of two single yarns ($t_2$ = 3.5 twists/inch) |
| Fraying length(cm) after 1st washing | 3.7 | 0.0 |
| Fraying length(cm) after 10th washing | 7.8 | 0.7 |
| Weight loss(%) after 10th washing | 18.5 | 5.0 |

Samples 1 and 2 and a yarn formed by folding the same single yarns as mentioned above without subjecting them to the mercerizing treatment (folding and twisting conditions being the same as in samples 1 and 2) were subjected in the state wetted and swollen with water to tensile strength test by employing a KM sliver tester under the following conditions:

sliver tester: constant rate elongation type
pulling rate: 25.4 cm/min.
grip distance: 4 cm.

Both the folded yarns and single yarns constituting the folded yarns were tested in the state wetted and swollen with water.

Test results are shown in Table 13.

Table 13

| Tested yarn | Tensile strength (kg) |
|---|---|
| Sample 1 | 18.8 |
| Sample 2 | 21.6 |
| Unmercerized fold yarn | 16.4 |
| Single yarn of sample 1 | 7.2 |
| Single yarn of sample 2 | 7.8 |
| Single yarn of unmercerized folded yarn | 7.6 |

From the foregoing results, it will readily be understood that a yarn formed by mercerizing single yarns in advance and then folding them is inferior in the washing resistance to a yarn formed by folding single yarns in advance and mercerizing the resulting folded yarn.

What we claim is:

1. A mop having an excellent washing resistance, which comprises a fibrous substrate and piles fixed on said fibrous substrate, each of said piles having an apparent diameter ranging from 2 to 10 mm. and a length of 3 to 30 cm. as measured from the cut end point to the point fixed on the substrate; wherein each of said piles is obtained by subjecting a yarn composed of a loosely twisted fold yarn of a plurality of thick single yarns of cotton fibers or a mixture of at least 70% by weight of cotton fibers with up to 30% by weight of artificial fibers, to the mercerizing treatment substantially under no tension under such conditions that the yarn is contracted by 10 to 30% in the longitudinal direction, said starting yarn having a single yarn twist coefficient of 3 to 4 as calculated from the following formula $$K = \frac{t_1}{\sqrt{S}}$$

wherein K designates the twist coefficient of the single yarn, $t_1$ stands for the twist number (twists/inch) of the single yarn and S designates the number of the count of the single yarn, and having a folded yarn twist coefficient of 1 to 2 as calculated from the following formula $$f = \frac{t_2}{t_1} \times \sqrt{N}$$

wherein $f$ designates the twist coefficient to the folded yarn, $t_1$ stands for the twist number (twists/inch) of the single yarn, $t_2$ designates the twist number (twists/inch) of the folded yarn and N stands for the number of single yarns constituting the folded yarn; each of said piles is substantially prevented completely from fraying from the cut end at the time of washing being owed to said mercerizing treatment; and wherein the mop is impregnated with 10 to 30% by weight, based on the mop, of an oil composition comprising as the main ingredient a non-drying mineral oil and containing 0.5 to 20% by weight bases on the total oil composition, of a catonic surfactant or a combination of a catonic surfactant and a non-ionic surfactant.

2. A mop set forth in claim 1 wherein the oil composition is impregnated in an amount of 18 to 26% by weight based on the mop.

* * * * *